US005950279A

United States Patent [19]

Chaput

[11] Patent Number: 5,950,279

[45] Date of Patent: Sep. 14, 1999

[54] MODULAR SLIDING DOOR ROLLERS

[75] Inventor: Ivanhoe Chaput, Torrence, Calif.

[73] Assignee: Reflectolite Products Company, Inc., Sun Valley, Calif.

[21] Appl. No.: 08/959,764

[22] Filed: Oct. 29, 1997

[51] Int. Cl.[6] ..... A47H 15/00

[52] U.S. Cl. ..... 16/105; 49/425

[58] Field of Search ..... 16/105, 91, 97, 16/99, 102, 106, 107; 49/425; 160/196.2

[56] References Cited

U.S. PATENT DOCUMENTS

| | | | |
|---|---|---|---|
| 3,517,459 | 6/1970 | Schupper | 49/425 |
| 3,670,357 | 6/1972 | Steigerwald | 16/105 |
| 4,112,540 | 9/1978 | Wright et al. | 49/425 |
| 4,262,451 | 4/1981 | Dallaire | 16/105 |
| 5,018,306 | 5/1991 | Prevot | 49/425 |

FOREIGN PATENT DOCUMENTS

| | | | |
|---|---|---|---|
| 563015 | 9/1993 | European Pat. Off. | 49/425 |
| 2477623 | 9/1981 | France | 49/425 |
| 137019 | 5/1994 | Japan | 49/425 |

OTHER PUBLICATIONS

Reflectolite Product Literature, 19 pages, known at least prior to filing the patent application.

*Primary Examiner*—Chuck Y. Mah
*Attorney, Agent, or Firm*—Hill & Simpson

[57] ABSTRACT

The present invention provides modular sliding door rollers for use in sliding doors. The modular sliding door rollers have a major roller unit and one or more minor roller units modularly connected together in series. The major and minor roller units have a roller which is adjustable to extend out of and retract into the major and minor roller units by adjusting a roller adjuster on the major roller unit. Two pairs of partially overlapping and divergent roller axle slots are provided on each of the major and minor roller units to provide for extension and retraction of the rollers.

27 Claims, 5 Drawing Sheets

MODULAR SLIDING DOOR ROLLERS

FIELD OF THE INVENTION

The present invention generally relates to sliding door rollers for use in sliding doors and more specifically, the present invention relates to new modular sliding door rollers for use in sliding doors.

BACKGROUND OF THE INVENTION

Sliding doors are a well known type of doors and are commonly used in a variety of applications, for example residential applications and commercial applications. Sliding doors typically include rollers mounted at the bottom of the door which roll on a track and permit the door to slide open and closed. Existing sliding door rollers have been made in assemblies that contain a single roller or multiple rollers. However, existing sliding door roller assemblies have not been modular such that the number of rollers can be easily varied depending on the particular application requirements for the sliding door.

Sliding doors are currently manufactured in a variety of sizes. Sliding doors having a size of up to 10' high and up to 4' wide are common. Oversized doors having larger heights and widths have also been manufactured. Oversized sliding doors are generally heavier than the more standard sized sliding doors due to the increased size and may require larger sliding door rollers. There has also been a tendency to increase the weight of sliding doors which may also require the use of larger sliding door rollers. For example, dual glazing of glass sliding doors increases the weight of such doors. Sliding door manufacturers, as with many manufacturers in general, strive to control inventory. Accordingly, sliding door manufacturers desire to reduce the number of components carried in inventory that are required to make sliding doors. Sliding door manufacturers may stock only larger rollers because the larger sliding door rollers can be used for standard, heavy and oversized sliding doors. Sliding door manufacturers may not stock smaller sliding door rollers in an attempt to control inventory and reduce manufacturing costs. However, utilizing relatively large sliding door rollers may result in over rollering smaller size and lighter doors.

Existing sliding door roller assembles have been adjustable such that the roller can be moved to various height positions. Adjustment of the roller allows for installation of the sliding door onto the roller track and also allows for proper adjustment of the sliding door on the roller track. Existing sliding door rollers have been adjustable by pivoting the roller about a pivot point when an adjustment screw is rotated. Other sliding door rollers have been adjustable by rotating an adjustment screw which slides the axle of the roller along a slot in a roller housing in which the slot is at an angle relative to vertical. Such roller assemblies having a povitable adjustment or an angled slot adjustment require the roller to move horizontally as well as vertically. Horizontal movement of the roller during adjustment of the roller requires increased space around the roller to permit horizontal movement of the roller. Also, the adjustment screw must be adjusted further to move the roller horizontally and vertically as compared to a mere vertical movement. Sliding door roller assemblies have also been made which have a vertical slot for a vertical only adjustment of the roller. However, such roller assemblies which provide only vertical adjustment of the roller can be simplified and improved.

Accordingly, one advantage would be to improve sliding door rollers used for sliding doors, and more particularly improve sliding door rollers by providing modular roller assemblies which can be connected together to provide as many rollers as desired for the particular application of the sliding door. Another advantage would be to improve the structure of sliding door rollers by improving the adjustment of the roller.

SUMMARY OF THE INVENTION

The present invention provides new sliding door rollers, particularly modular sliding door rollers, for use in sliding doors. Multiple modular sliding door rollers of the present invention can be connected together as desired for a particular sliding door application. Accordingly, the modular sliding door rollers can be used with various sizes, weights and types of sliding doors such as smaller, lighter weight sliding doors and larger, heavier weight sliding doors. For any particular sliding door application, a desired number of the modular sliding door rollers is selected and connected together into an assembly. The modular sliding door roller assembly is installed into the sliding door and sliding door can then be installed onto the sliding door track.

Because the new sliding door rollers of the present invention are modular, the number of different sliding door rollers used in manufacturing sliding doors can be reduced. Reducing the number of different sliding door rollers used to manufacture sliding doors increases the efficiency of sliding door manufacturing and reduces manufacturing costs. Also, the modular sliding door rollers improves inventory control because a fewer number of different sliding door rollers need to be stocked in inventory. For example, a relatively small number of the modular sliding door rollers can be connected together for a sliding door application which requires relatively lighter rolling, e.g., smaller and lighter weight sliding doors. A relatively larger number of the modular sliding door rollers can be connected together for sliding door applications which require heavier rolling, for example larger and heavier sliding doors.

One modular sliding door roller according to the present invention includes a major roller unit having a modular connection end and a roller wheel adjustment end, and a minor roller unit having opposed modular connection ends. The modular connection end of the major roller unit is connected to one of the modular connection ends of the minor roller unit. Additional minor roller units may be connected together in series as desired. The major and minor roller units each have a roller which is adjustable to extend out of or retract into its respective roller unit. The major roller unit has an adjustment mechanism, such as an adjustment screw, which concurrently adjusts all of the rollers in the connected together modular sliding door roller.

One major roller unit of the present invention may be simply constructed of four component parts. The major roller unit may include a major inner housing slidably positioned inside of a major outer housing and a roller positioned inside of the major inner housing. A roller adjuster is connected to the major inner housing to extend or retract the roller. The minor roller unit may also be simply constructed of three component parts. The minor roller unit may have a minor outer housing and a minor inner housing slidably positioned within the minor outer housing. Another roller is adjustably positioned within the minor inner housing. The major and minor roller units can be modularly connected together such that when the roller in the major roller unit is adjusted the roller in the minor roller unit is concurrently adjusted.

One modular sliding door roller according to the present invention may have two pairs of cooperative slots for each roller for adjustment of the roller. The two slots in each pair of cooperative slots are divergent from each other, for example one slot may be vertical and the other slot may be positioned at an angle relative to vertical. The vertical and angled slots overlap each other and an axle of the roller is positioned in the overlap area of the slots. As an inner housing having the angled slot is slid relative to an outer housing having the vertical slot, the slot overlap area and the roller are moved along both slots and particularly moved vertically to extend or retract relative to the modular sliding door roller.

The new modular sliding door rollers provide convenient and cost effective ways of making and using sliding door rollers for sliding doors. The new sliding door rollers are modular so that a desired number of the sliding door rollers can be connected together for a particular sliding door application.

Therefore, an advantage of the present invention is to provide modular sliding door rollers for use in sliding doors.

Another advantage of the present invention is to provide sliding door rollers which can be connected together in a desired number for a particular sliding door application.

Another advantage of the present invention is to reduce the number of the different sliding door rollers needed for manufacturing sliding doors.

Another advantage of the present invention is to provide divergent, cooperative slots for extending and retracting a roller out of the sliding door roller assembly.

Another advantage of the present invention is to provide modular sliding 5 door rollers having a major roller unit and a minor roller unit. The major roller unit has a major connection end and a first roller adjustably extending out of an interior of the major roller unit. A roller adjuster is provided on the major roller unit and linked to the roller for adjusting the roller. The minor roller unit has opposing first and second minor connection ends in which the first minor connection end is connected to the major connection end of the major roller unit. A second roller adjustably extends out of an interior of the minor roller unit and is linked to the roller adjuster by the major connection end being connected to the first minor connection end.

Other objects and advantages of the present invention will become apparent upon reading this disclosure including the appendant claims with reference to the accompanying drawings.

DETAILED DESCRIPTION OF THE PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 2:
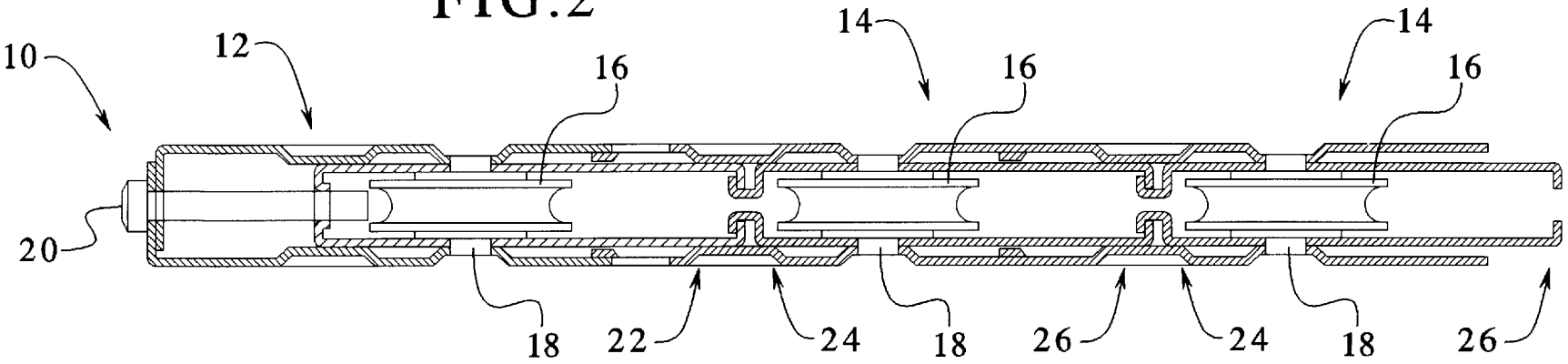
FIG. 2 is a cross-sectional view of the modular sliding door roller along the line II—II of FIG. 1.
Figure 1:
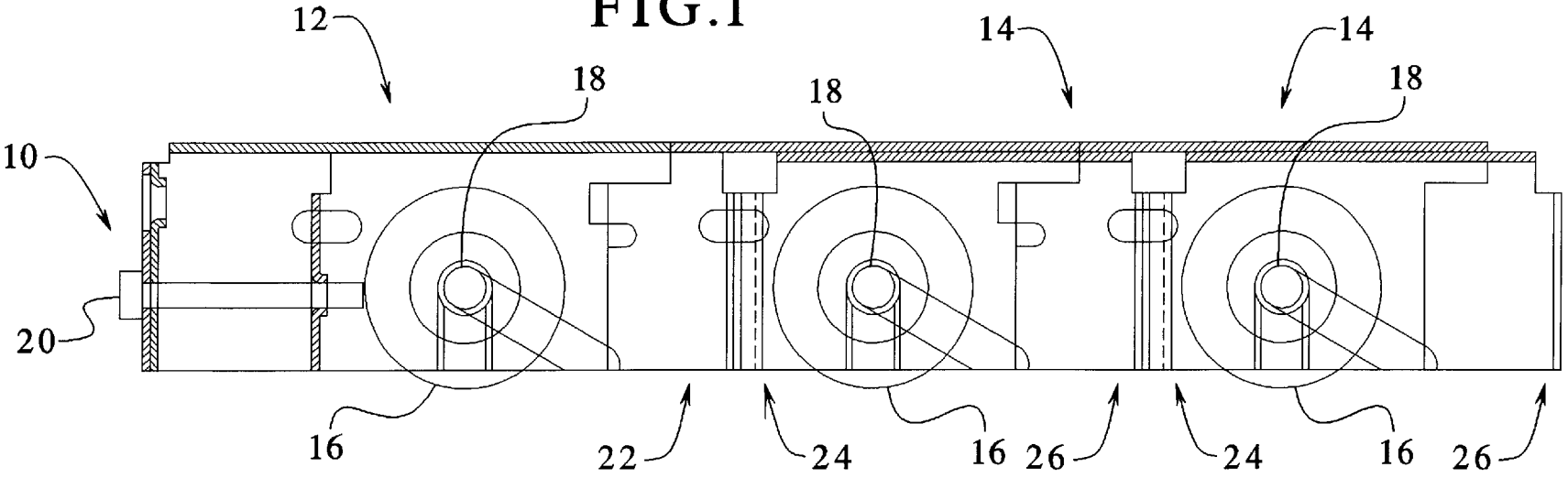
FIG. 1 is a side elevational view of a modular sliding door roller according to the principles of the present invention shown in partial cross-section and in a roller retracted position.

A new modular sliding door roller 10 according to the principles of present invention is shown by way of example in FIGS. 1 and 2. The modular sliding door roller 10 is particularly useful for mounting on a sliding door so that the sliding door can slide or roll on a track. The modular sliding door roller 10 includes a major roller unit 12 and one or more minor roller units 14. Each of the major and minor roller units 12, 14 include a roller 16 rotatable about an axle 18. The rollers 16 are adjustable to extend out of and retract into the major and minor roller units 12, 14 and permit the sliding door containing the modular sliding door roller 10 to slide on the roller track. A roller adjuster, such as a set screw 20, is provided on the major roller unit 12 to adjust the rollers 16 in the major and minor roller units 12, 14.

The major and minor roller units 12, 14 are modularly connected together to form the modular sliding door roller 10. A major connection end 22 of the major roller unit 12 is removably connected to a minor connection end 24 on the minor roller unit 14. The minor roller unit 14 has another minor connection end 26 opposite the minor connection end 24. In the embodiment of the present invention shown in FIGS. 1 and 2, the major connection end 22 of the major roller unit 12 has the same configuration as the minor connection end 26 of the minor roller unit 14. Both of the minor connection ends 24, 26 of adjacent minor roller units 14 are constructed such that they are engageable with each other. For example, the minor connection end 26 of one minor roller unit 14 can be connected to the minor connection end 24 of an adjacent minor roller unit 14, as can be seen in FIG. 2. In this manner, a desired number of minor roller units 14 can be modularly connected together in series. The connections between the major and minor roller units 12, 14 are shown as being removable; however, the present invention contemplates non-removable connections between the roller units.

Figure 4:
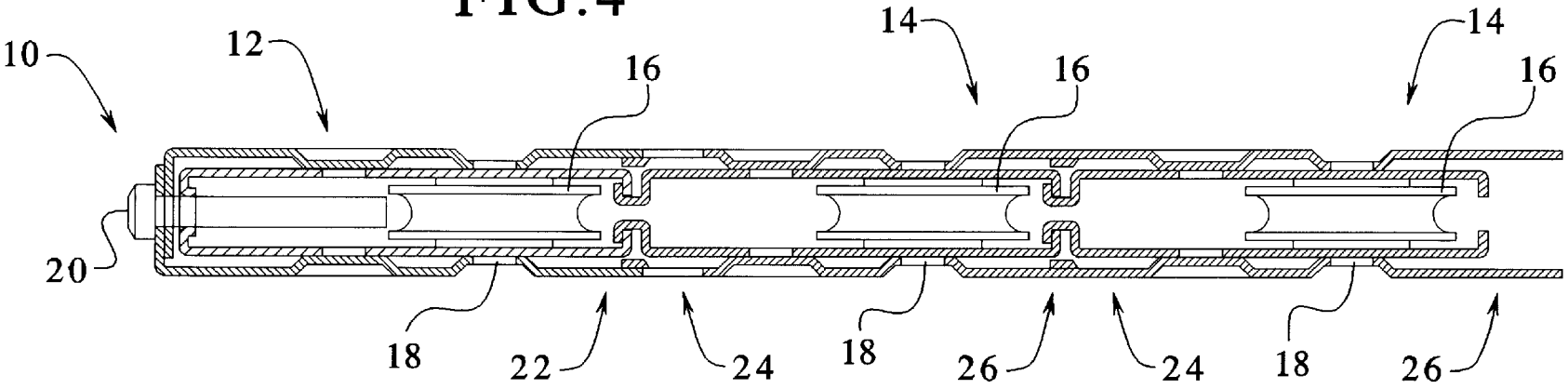
FIG. 4 is a cross-sectional view of the modular sliding door roller of FIG. 3 along the line IV—IV.
Figure 3:
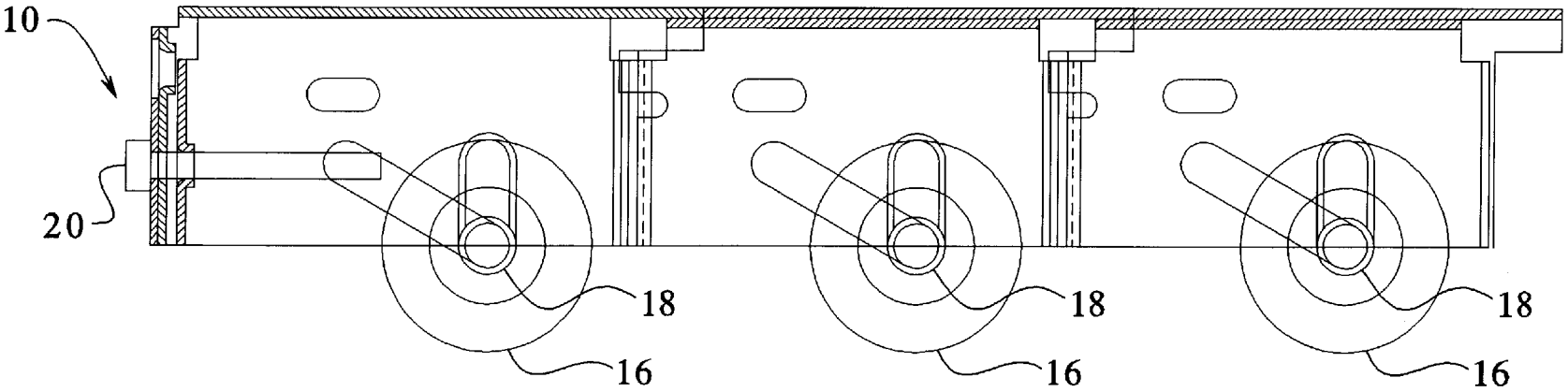
FIG. 3 is a side elevational view of the modular sliding door roller of FIG. 1 shown in partial cross-section and in a roller extended position.

FIGS. 1 and 2 show the modular sliding door roller 10 in a position having the rollers 16 adjusted to their highest position, i.e., the rollers 16 are fully retracted into the modular sliding door roller 10. FIGS. 3 and 4 show the modular sliding door roller 10 having the rollers 16 adjusted to their lowest position, i.e., the rollers 16 are fully extended out of the modular sliding door roller 10. Further outward adjustment of the rollers 16 would permit the rollers 16 to be removed from the major and minor roller units 12, 14. Adjustment of the positions of the rollers 16 will be more fully described below.

Figure 6:
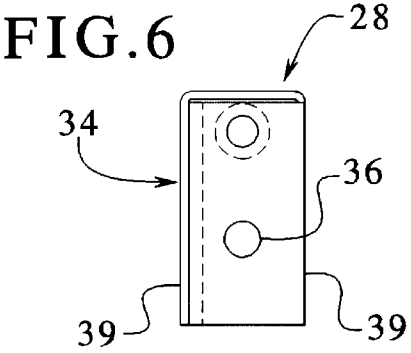
FIG. 6 is a side view of the major outer housing of FIG. 5.
Figure 8:
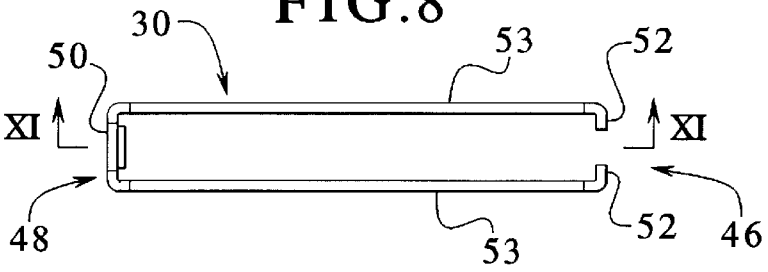
FIG. 8 is a top view of a major inner housing of the modular sliding door roller of FIG. 1.
Figure 9:
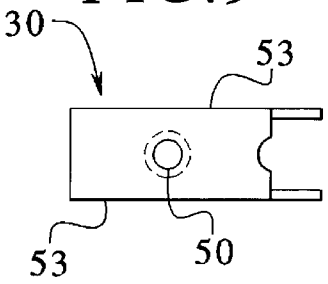
FIG. 9 is a side view of the major inner housing of FIG. 8.
Figure 5:
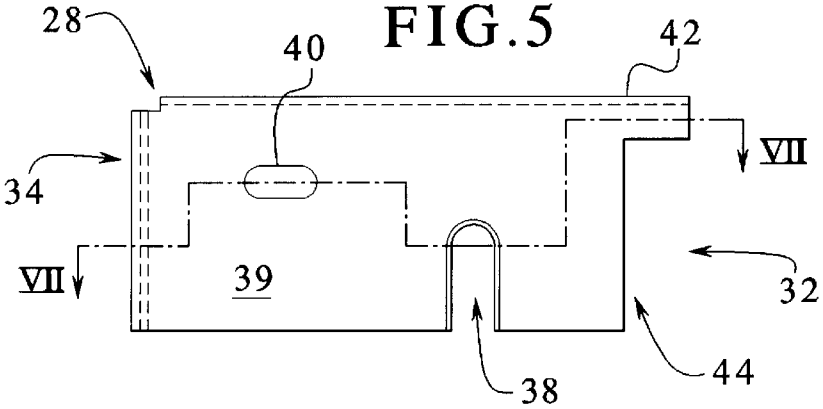
FIG. 5 is a front elevational view of a major outer housing of the modular sliding door roller of FIG. 1.
Figure 7:
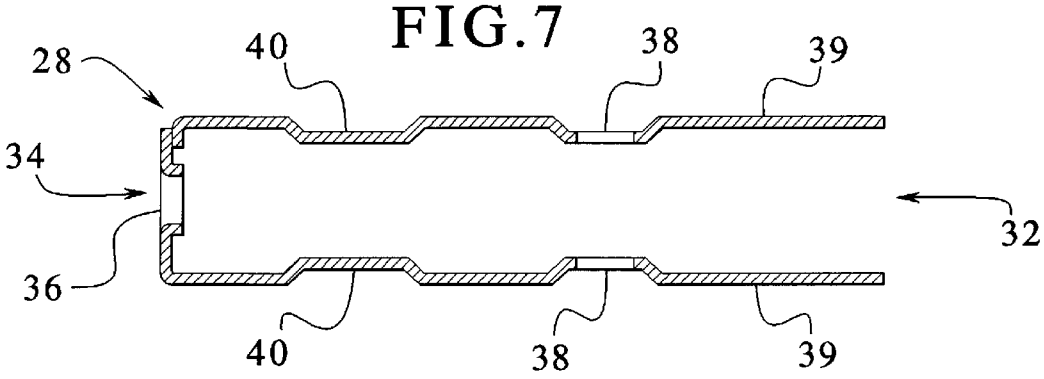
FIG. 7 is a cross-sectional view of the major outer housing along the line VII—VII of FIG. 5.

The major roller unit 12 includes a major outer housing 28 and a major inner housing 30 which is positioned within and slidable relative to the major outer housing 28. The major outer housing 28 is shown in FIGS. 5–7, and includes a major outer end 32 and an adjustment end 34. A hole 36 is provided at the adjustment end 34 for the set screw 20 to extend from the major outer housing 28 to the major inner housing 30 (FIGS. 1–4). The major outer end 32 forms part of the major connection end 22 of the major roller unit 12 for connection to the minor connection end 24 of the minor roller unit 14. A pair of vertical slots 38 are provided in opposed walls 39 of the major outer housing 28. The pair of slots 38 receive the axle 18 of the roller 16 in the major roller unit 12. A pair of slide guides 40 in the form of indentations in the opposed walls 39 of the major outer housing 28 are provided to guide the major inner housing 30 when the major inner housing 30 slides relative to the major outer housing 28. The opposed walls 39 of the major outer housing 28 may also be indented in the area of the pair of slots 38 to assist in guiding the major inner housing 30 within the major outer housing 28. The major outer end 32 has an extension 42 at the top and defines cut-outs 44 in the opposing walls 39 of the major outer housing 28.

The major inner housing 30 is shown in FIGS. 8–11 and has a major inner end 46 and an opposite adjustment end 48. A threaded hole 50 is provided in the adjustment end 48 so that the set screw 20 can threadingly engage the major inner housing 30 for adjusting the rollers 16. The major inner end 46 has a pair of opposed interlocking tabs 52 extending inward from outside walls 53 of the major inner housing 30. The major inner end 46 of the major inner housing 30 together with the major outer end 32 of the major outer housing 28 form the major connection end 22 of the major roller unit 12. A pair of angled slots 54 are provided in the outside walls 53 of the major inner housing 30 for receiving the axle 18 of the roller 16 in the major roller unit 12.

Figure 12:
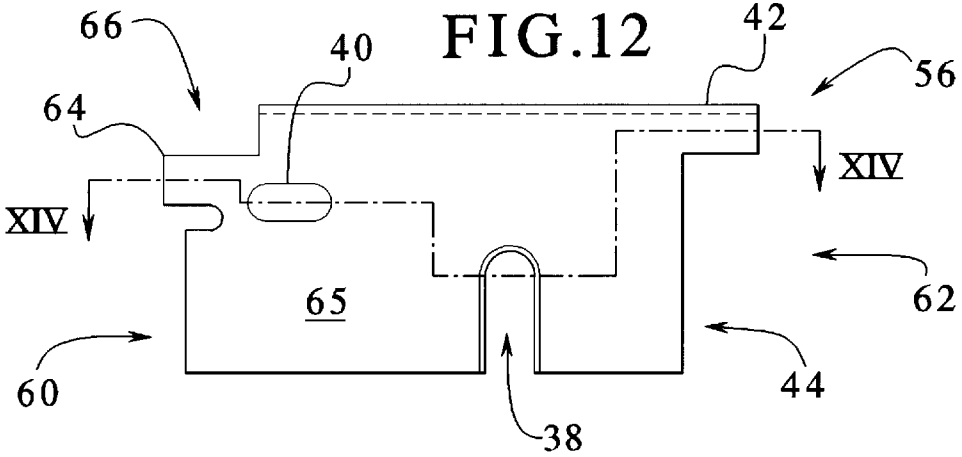
FIG. 12 is a front elevational view of a minor outer housing of the modular sliding door roller of FIG. 1.
Figure 14:
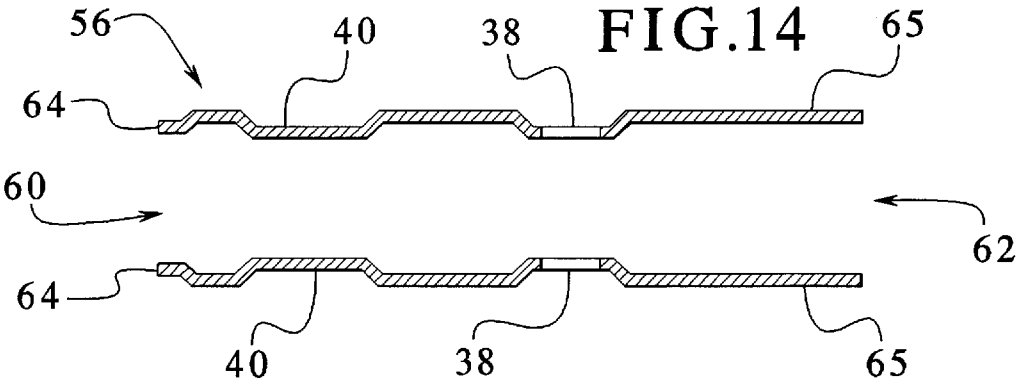
FIG. 14 is a cross-sectional view of the minor outer housing along the line XIV—XIV of FIG. 12.
Figure 11:
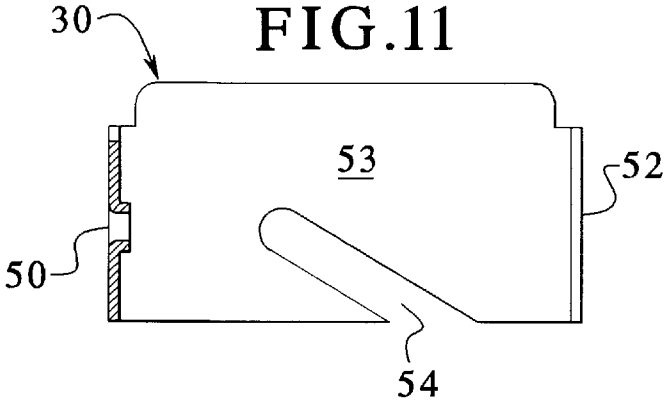
FIG. 11 is a cross-sectional view of the major inner housing along the line XI—XI of FIG. 8.
Figure 10:
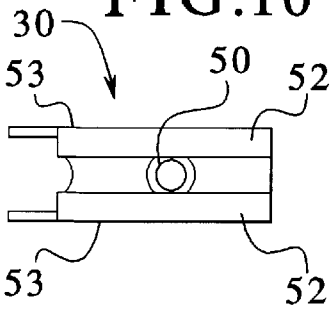
FIG. 10 is another side view of the major inner housing in FIG. 8.
Figure 13:
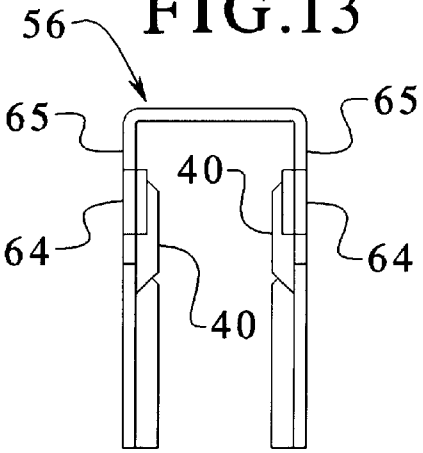
FIG. 13 is a side view of the minor outer housing of FIG. 12.

Referring to FIGS. 1–4, minor roller unit 14 includes a minor outer housing 56 and a minor inner housing 58 which is slidably positioned within the minor outer housing 56. The minor outer housing 56 is shown in FIGS. 12–14 and has a first minor outer end 60 opposite a second minor outer end 62. A pair of extending tabs 64 are provided on the opposite walls 65 of the minor outer housing 56 at the first minor outer end 60. The pair of tabs 64 are bent toward the inside of the minor outer housing 56 to be offset from the outer walls 65. The tabs 64 overlap the outer walls 39 on the inside of the major outer housing 28 when the major and minor roller units 12, 14 are connected together. Also, the extension 42 of the major outer end 32 on the major outer housing 28 extends into a cut-out 66 at the top of the first minor outer end 60 of the minor outer housing 56. The second minor outer end 62 of the minor outer housing 56 has an extension 42 and a pair of cut-outs 44 similar to those of the major outer end 32 in the major outer housing 28. A pair of vertical slots 38 are provided in the opposed outer walls 65 of the minor outer housing 56 for receiving the axle 18 of the roller 16 in the minor roller unit 14. The minor outer housing 56 has a pair of slide guides 40 or indentations for guiding the minor inner housing 58 when the minor inner housing 58 slides within the minor outer housing 56. The outside walls 65 of the minor outer housing 56 may also be indented in the area of the vertical slots 38 for guiding the minor inner housing 58.

Figure 15:
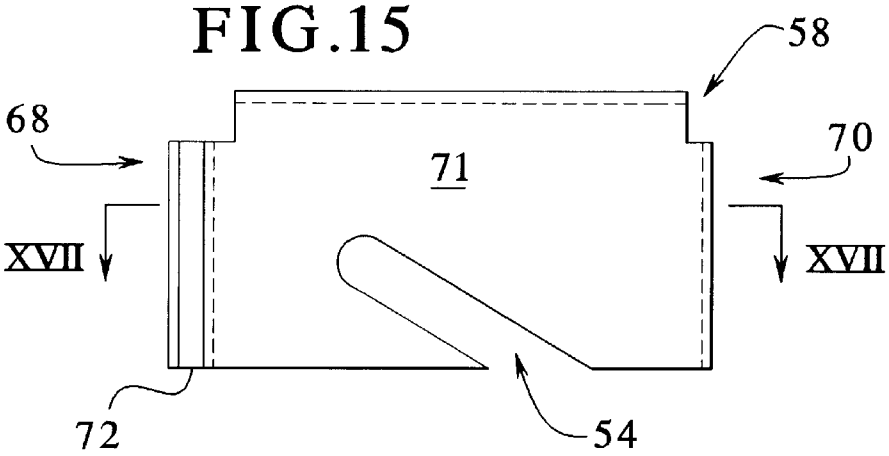
FIG. 15 is a front elevational view of a minor inner housing of the modular sliding door roller of FIG. 1.
Figure 17:
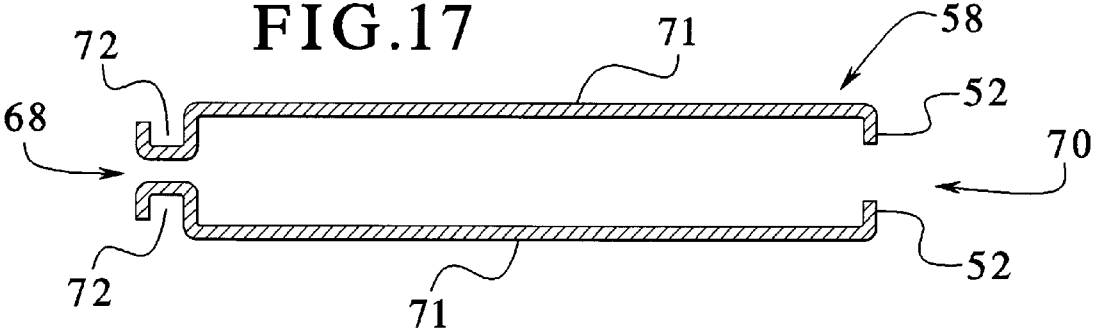
FIG. 17 is a cross-sectional view of the minor inner housing along the line XVII—XVII of FIG. 15.
Figure 16:
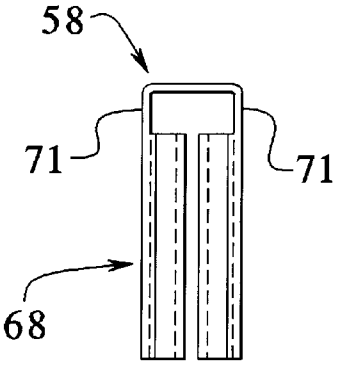
FIG. 16 is a side view of the minor inner housing of FIG. 15.

The minor inner housing 58 is shown in FIGS. 15–17 and has a first minor inner end 68 opposite a second minor inner end 70. The first minor inner end 68 has a pair of interlocking channels 72 which engage and interlock with the pair of interlocking tabs 52 on the major inner end 46 of the major inner housing 30. The second minor inner end 70 of the minor inner housing 58 has a pair of interlocking tabs 52 extending inward from outer walls 71. Accordingly, the interlocking tabs 52 of the minor inner housing 58 of one minor roller unit 14 can engage and interlock with the first minor end 68 of the minor inner housing 58 on an adjacent minor roller unit 14. Similarly, the second minor outer end 62 of the minor outer housing 56 on one minor roller unit 14 can connect with the first minor outer end 60 of the minor outer housing 56 on an adjacent minor roller unit 14. A pair of angled slots 54 are provided in the opposite walls 71 of the minor inner housing 58 for receiving the axle 18 of the roller 16.

Referring to FIGS. 1–4, one method of making and adjusting a modular sliding door roller 10 according to the principles of the present invention will now be described. A major roller unit 12 and a minor roller unit 14 are removably connected together. More specifically, the major connection end 22 of the major roller unit 12 is removably connected to the minor connection end 24 of the minor roller unit 14. The connection between the major and minor roller units 12, 14 is made by sliding the interlocking tabs 52 of the major inner housing 30 into the interlocking channels 72 of the minor inner housing 58. Also, the major outer end 32 of the major outer housing 28 and the first minor outer end 60 of the minor outer housing 56 are brought into overlapping engagement. If additional minor roller units 14 are desired, the minor roller units 14 are similarly connected to an adjacent minor roller unit 14.

The modular sliding door roller 10 is assembled to a sliding door, for example by connecting the major and minor outer housings 28, 56 of the major and minor roller units 12, 14 to the sliding door. The rollers 16 in the major and minor roller units 12, 14 are adjusted by rotating the set screw 20 in the major roller unit 12. As the set screw 20 is rotated, the major and minor inner housings 30, 58 slide within the major and minor outer housings 28, 56. Each one of the vertical slots 38 and the angled slots 54 partially overlap one another to form an overlap area which contains one end of the axle 18 of the roller 16. The overlap area changes position along the vertical and angled slots 38, 54 as the major and minor inner housings 30, 58 slide within their respective major and minor outer housing 28, 56. Accordingly, the axle 18 and the roller 16 move vertically following the overlap area along the vertical slots 38 in the major and minor outer housings 28, 56.

While the presently preferred embodiments have been illustrated and described, numerous changes and modifications can be made without significantly departing from the spirit and scope of this invention. Therefore, the inventor intends that such changes and modifications are covered by the appended claims.

The invention is claimed as:

1. A modular sliding door roller comprising:

a major roller unit having a major connection end, a first roller adjustably extending out of an interior of the major roller unit, and a roller adjustor linked to the roller; and at least one minor roller unit having opposing first and second minor connection ends, the first minor connection end engaged with the major connection end of the major roller unit, and a second roller adjustably extending out of an interior of the minor roller unit, the second roller linked to the roller adjustor by the major connection end being engaged with the first minor connection end.

2. The modular sliding door roller of claim 1 wherein said at least one minor roller unit comprises a plurality of minor roller units, the first minor connection end of one minor roller unit engaged with the major connection end of the major roller unit, the first connection end of remaining minor roller units, engaged with the second minor connection end of an adjacent minor roller unit.

3. The modular sliding door roller of claim 2 wherein the first connection end of each remaining minor roller unit is removably engaged with the second minor connection end of its adjacent minor roller unit.

4. The modular sliding door roller chain of claim 1 wherein the major connection end of the major roller unit has the same configuration as the second minor connection end of the minor roller unit.

5. The modular sliding door roller of claim 1 wherein the major connection end of the major roller unit and the first minor connection end of the minor roller unit are removably engaged together.

6. The modular sliding door roller of claim 1 wherein the roller adjustor comprises a threaded member extending from a major outer housing to a threaded engagement with a major inner housing, and wherein the first roller is positioned within the major inner housing.

7. The modular sliding door roller of claim 1 wherein the major roller unit further comprises a major outer housing and a major inner housing slidably positioned within the major outer housing.

8. The modular sliding door roller of claim 7 wherein the major outer housing defines a pair of opposed major outer housing roller axle slots and the major inner housing defines a pair of opposed major inner housing roller axle slots, each one of the major inner housing roller axle slots partially overlapping one of the major outer housing roller axle slots at an overlap area, the overlap area changing position along the major outer and inner housing roller axle slots as the major inner housing slides within the major outer housing.

9. The modular sliding door roller of claim 8 wherein the first roller has an axle positioned in the overlap areas.

10. The modular sliding door roller of claim 8 wherein each of the major outer housing roller axle slots is approximately vertical and each of the major inner housing roller axle slots is angled with respect to the major outer housing roller axle slot.

11. The modular sliding door roller of claim 7 wherein the major outer housing further comprises a slide guide extending toward the major inner housing.

12. The modular sliding door roller of claim 1 wherein the minor roller unit further comprises a minor outer housing and a minor inner housing slidably positioned within the minor outer housing.

13. The modular sliding door roller of claim 12 wherein the minor outer housing defines a pair of opposed minor outer housing roller axle slots and the minor inner housing defines a pair of opposed minor inner housing roller axle slots, each one of the minor inner housing roller axle slots partially overlapping one of the minor outer housing roller axle slots at an overlap area, the overlap area changing position along the minor outer and inner housing roller axle slots as the minor inner housing slides within the minor outer housing.

14. The modular sliding door roller of claim 13 wherein the second roller has an axle positioned in the overlap areas.

15. The modular sliding door roller of claim 13 wherein each of the minor outer housing roller axle slots is approximately vertical and each of the minor inner housing roller axle slots is angled with respect to the minor outer housing roller axle slot.

16. The modular sliding door roller of claim 12 wherein the minor outer housing further comprises a slide guide extending toward the minor inner housing.

17. The modular sliding door roller of claim 1 wherein the major roller unit further comprises a major outer housing and a major inner housing slidably positioned within the major outer housing, and wherein the minor roller unit further comprises a minor outer housing and a minor inner housing slidably positioned within the minor outer housing.

18. The modular sliding door roller of claim 17 wherein the major outer housing is engaged with the minor outer housing and the major inner housing is engaged with the minor inner housing.

19. The modular sliding door roller of claim 18 wherein the minor inner housing defines a pair of interlocking channels and the major inner housing has a pair of interlocking tabs positioned within the interlocking channels of the minor inner housing.

20. The modular sliding door roller claim 1 wherein the major connection end comprises a major outer end adjacent a major inner end, and wherein the first minor connection end comprises a first minor outer end connected to the major outer end and a first minor inner end connected to the major inner end.

21. The modular sliding door roller of claim 20 wherein the major and first minor outer ends at least partially overlap each other, the minor inner end defines a connection channel, and the major inner end has a tab received in the connection channel.

22. A modular sliding door roller comprising:

a major roller unit comprising:

a major inner housing slidably positioned inside of a major outer housing, the major outer housing defining a pair of opposed major outer axle slots, the major inner housing defining a pair of opposed major inner axle slots partially overlapping the major outer axle slots;

a major roller having an axle positioned in the overlapped pairs of the major inner and outer axle slots; and a roller adjustor threadingly engaged with the major inner housing; and a minor roller unit comprising:

a minor inner housing slidably positioned inside of a minor outer housing, the minor outer housing defining a pair of opposed minor outer axle slots, the minor inner housing defining a pair of opposed minor inner axle slots partially overlapping the minor outer axle slots, the minor outer housing removably connected to the major outer housing and the minor inner housing removably connected to the major inner housing; and a minor roller having an axle positioned in the overlapped pairs of the minor inner and outer axle slots.

23. The modular sliding door roller of claim 22 further comprising a second minor roller unit which is the same as the other minor roller unit, the minor outer and inner housings of the second minor roller unit removably connected to the minor outer and inner housings of the other minor roller unit, respectively.

24. A method of making a sliding door roller comprising the steps of:

providing a major roller unit having a modular major connection;

providing a selected number of minor roller units, each minor roller unit having first and second modular minor connections;

connecting one of the minor roller units to the major roller unit by connecting the first modular minor connection to the modular major connection; and connecting each of remaining minor roller units to an adjacent minor roller unit by connecting the first modular minor connections to the second modular minor connections.

25. The method of claim 24 further comprising the steps of:

adjusting a position of a roller in the major roller unit; and adjusting positions of rollers in each of the minor roller units though the connection between the major and minor roller units and through the connections between adjacent minor roller units.

26. A sliding door roller comprising:

a major roller unit having and end, a major connector, and a first roller extending out of an interior of the major roller unit; and a minor roller unit having an end and a first minor connector, the first minor connector having a first position separated from the major connector of the major roller unit prior to assembly of the major roller unit and the minor roller unit together and a second position connected to the major connector of the major roller unit such that the ends of the major and minor units are facing each other after assembly of the major roller unit and the minor roller unit together, and a second roller extending out of an interior of the minor roller unit.

27. The sliding door roller of claim 26 wherein the minor roller unit further has a second minor connector and wherein the sliding door roller further comprises another minor roller unit having another first minor connector which is connected to the second minor connector of the minor roller unit connected to the major connection of the major roller unit.

* * * * *